US006249266B1

(12) United States Patent
Kishino et al.

(10) Patent No.: US 6,249,266 B1
(45) Date of Patent: Jun. 19, 2001

(54) FLUORESCENT DISPLAY DEVICE AND PROCESS FOR MANUFACTURING SAME

(75) Inventors: Takao Kishino; Hisashi Nakata, both of Mobara (JP)

(73) Assignee: Futaba Denshi Kogyo K.K., Mobara (JP)

( * ) Notice: Subject to any disclaimer, the term of this patent is extended or adjusted under 35 U.S.C. 154(b) by 1390 days.

(21) Appl. No.: 08/514,718

(22) Filed: Aug. 14, 1995

Related U.S. Application Data

(63) Continuation of application No. 08/182,342, filed on Jan. 18, 1994, now abandoned.

(30) Foreign Application Priority Data

Jan. 18, 1993 (JP) ..... 5-005916

(51) Int. Cl.[7] ..... G09G 3/22
(52) U.S. Cl. ..... 345/75.1; 313/495; 313/496
(58) Field of Search ..... 313/483–496, 313/306, 567; 345/75, 55, 147; 445/24; 220/2.2

(56) References Cited

U.S. PATENT DOCUMENTS 4,138,622 * 2/1979 McCormick et al. ..... 313/306
4,164,683 * 8/1979 Nakamura et al. ..... 313/496
4,377,769 * 3/1983 Beatty et al. ..... 313/495
4,582,210 * 4/1986 Morimoto et al. ..... 313/567

* cited by examiner

*Primary Examiner*—Amare Mengistu
(74) *Attorney, Agent, or Firm*—Oblon, Spivak, McClelland, Maier & Neustadt, P.C.

(57) ABSTRACT

A fluorescent display device including a planar cathode is provided which is capable of carrying out setting of an interval between a cathode and an anode and alignment therebetween with high precision. A cathode substrate having an FEC formed thereon is mounted through a lead frame on support members. Lead wires of the lead frame are abutted against bumps on the cathode substrate. An anode substrate having a holding frame attached thereto is positioned with respect to the cathode substrate and the holding frame and lead frame are fixed to each other. Both substrates thus temporarily fixed to each other are combined with a casing while keeping the cathode substrate facing down. Then, the anode substrate and casing are sealedly connected to each other.

9 Claims, 4 Drawing Sheets

FLUORESCENT DISPLAY DEVICE AND PROCESS FOR MANUFACTURING SAME

This application is a Continuation application Ser. No. 08/182.342, filed on Jan. 18, 1994, now abandoned

BACKGROUND OF THE INVENTION

This invention relates to a fluorescent display device and a process for manufacturing the same, and more particularly to a fluorescent display device having a planar cathode incorporated therein and a process for manufacturing the same.

In general, a fluorescent display device includes a box-line envelope of which an interior is evacuated to a high vacuum. The envelope is provided therein with a cathode acting as an electron source, a control electrode, and an anode having a phosphor deposited thereon so as to serve as a luminous display section. In the conventional fluorescent display device thus constructed, electrons emitted from the cathode are caused to selectively impinge on the phosphor while being controlled by the control electrode, so that the phosphor is selectively excited, resulting in a desired luminous display being carried out.

Recently, a planar cathode such as a field emission cathode (hereinafter referred to as "FEC") has been often used as a cathode for the fluorescent display device in place of a filamentary cathode. A typical spindt-type FEC includes an insulating layer and a gate electrode which are laminatedly formed on a cathode conductor of a cathode substrate. The insulating layer and gate electrode each are formed with a number of holes extending to the cathode conductor. The holes each are provided therein with an emitter of a conical shape in a manner to be positioned on the cathode conductor. Then, application of a voltage of a suitable level to each of the emitters and the gate electrode causes electrons to be emitted from the emitter.

The planar cathode such as an FEC or the like permits emission of electrons therefrom to be directly controlled by means of a voltage applied thereto. Thus, when the planar cathode is used as an electron source for the fluorescent display device, it is required that the cathode substrate on which the planar cathode is provided is arranged in proximity to the anode substrate on which the phosphor layer is deposited, to thereby prevent electron beams from spreading before they reach the anode. Also, when the phosphor is deposited in a strip-like or dot-like manner on the anode, it is required to align the phosphor layer of the anode with the cathode. This permits only control of the planar cathode to directly control a luminous display of the anode.

The conventional fluorescent display device includes a getter which is arranged so as to absorb residual gas thereon, to thereby permit the envelope to be evacuated to a high vacuum. Unfortunately, in order to accomplish this purpose, it is required to maintain, in the envelope, a space for arranging the getter. Thus, the conventional fluorescent display device, as shown in FIG. 6, is typically constructed in such a manner that an envelope 101 and a cathode substrate 100 are provided separate from each other, resulting in an interval between an anode 103 and a cathode 104 being adjusted depending on a thickness of the cathode substrate 100. Also, alignment between the anode 103 and the cathode 104 is carried out by previously positioning the cathode substrate 101 on one of front and rear plate members constituting the envelope 101 and then positioning the cathode substrate 100 with respect to the other plate member on which the anode 103 is formed.

In the conventional fluorescent display device thus constructed, the envelope 101 is formed by assembling the plate members by means of a sealing agent or material such as low-melting frit glass deposited on each of the plate members, fixing the plate members to each other by vertically applying a pressure thereto while interposedly holding them by means of a clip or the like, and subjecting the plate members to a heat treatment or calcination to melt the sealing material, resulting in the plate members being integrally connected to each other.

Thus, the envelope 101 is pressurized by the clip or the like which interposedly holds it, so that profile irregularity of side plates 102 of the envelope 101 causes misregistration between the plate members to occur during assembling of the envelope 101, resulting in alignment between the anode 103 and the cathode 104 in a horizontal direction being rendered highly difficult. Concurrently, profile irregularity of the side plates 102 requires to provide the interval between the anode 103 and the cathode 104 with allowance, thus, it is impossible to position the front and rear plate members in close proximity to each other and with high precision.

Further, in the conventional fluorescent display device, the envelope 101 is typically made of a glass plate. Also, the cathode plate 100 is often made of Si in the case that a drive circuit for the cathode 103 is formed on the cathode substrate 100. In this instance, when the fluorescent display device is so constructed that the cathode substrate 100 is mounted on one of the front and rear plate members of the envelope 101 in such a manner as conventionally employed in the art, a different in thermal expansion coefficient between the cathode substrate 100 and the plate member causes damage to either the cathode substrate 100 or the plate member of the envelope 101 during the heat treatment.

Furthermore, the conventional fluorescent display device is so constructed that the cathode substrate 100 on which the cathode 104 is arranged is formed separate from the envelope 101 on which the anode 103 is arranged. Such construction renders connection between each of electrode elements of the cathode 104 and a lead wire extending through a sealed section of the envelope 101 substantially hard. The connection is conventionally carried out by means of wire bondings 105. Unfortunately, this causes a disadvantage of failing to arrange the anode 103 and cathode 104 in proximity to each other because it is required to prevent a loop of a wire from contacting with each of the electrode elements.

SUMMARY OF THE INVENTION

The present invention has been made in view of the foregoing disadvantage of the prior art.

Accordingly, it is an object of the present invention to provide a fluorescent display device including a planar cathode which is capable of accomplishing alignment between the cathode and an anode in a horizontal direction with high precision.

It is another object of the present invention to provide a fluorescent display device including a planar cathode which is capable of arranging the cathode and an anode with respect to each other while decreasing an interval therebetween as desired.

It is a further object of the present invention to provide a fluorescent display device including a planar cathode which is capable of facilitating connection of wirings to the cathode.

It is still another object of the present invention to provide a process for manufacturing a fluorescent display device which is capable of manufacturing a fluorescent display device effectively accomplishing the above-described objects.

In accordance with one aspect of the present invention, a fluorescent display device is provided. The fluorescent display device includes an envelope formed by integrally attaching an substrate and a casing to each other through a sealing layer, an anode formed on the anode substrate in the envelope and having a phosphor layer deposited thereon, support members fixed on the sealing layer, a cathode substrate supported in the envelope by means of the support members in a manner to face the anode at a predetermined interval defined therebetween, a planar cathode formed on the cathode substrate, and lead wires arranged so as to extend through the sealing layer into the envelope and connected to the cathode substrate.

In a preferred embodiment of the present invention, the cathode substrate is formed of a material different in thermal expansion coefficient from a material for the casing.

In a preferred embodiment of the present invention, the planar cathode comprises an FEC.

In a preferred embodiment of the present invention, the fluorescent display device further includes a getter arranged between the cathode substrate and the casing for adsorbing residual gas.

In accordance with another aspect of the present invention, a process for manufacturing a fluorescent display device is provided. The process comprises the steps of mounting a cathode substrate formed thereon with a planar cathode through support members on a lead frame including lead wires, superposing a holding frame on which an anode substrate having an anode formed thereon is held through an outer periphery thereof on the lead frame in a manner to render the anode and cathode opposite to each other, adjusting a positional relationship between the anode and the cathode, connecting the lead frame and holding frame to each other, sealedly attaching the anode substrate and a casing to each other while interposedly holding lead wires of the lead frame between the anode substrate and the casing, resulting in providing an envelope, and removing the lead frame from the envelope.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 4(*b*) is a side elevation view of the anode substrate shown in FIG. 4(*a*);

DETAILED DESCRIPTION OF THE PREFERRED EMBODIMENTS

Now, the present invention will be described hereinafter with reference to the accompanying drawings.

Figure 1:
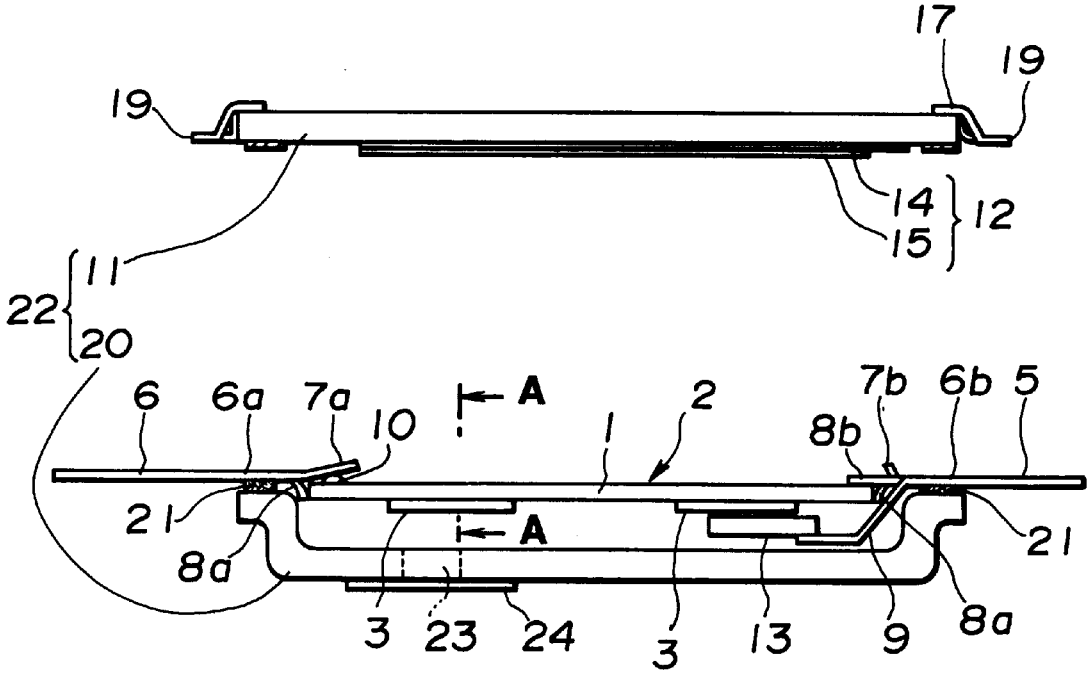
FIG. 1 is a sectional view showing one of steps in manufacturing of a fluorescent display device according an embodiment of to the present invention.
Figure 2:
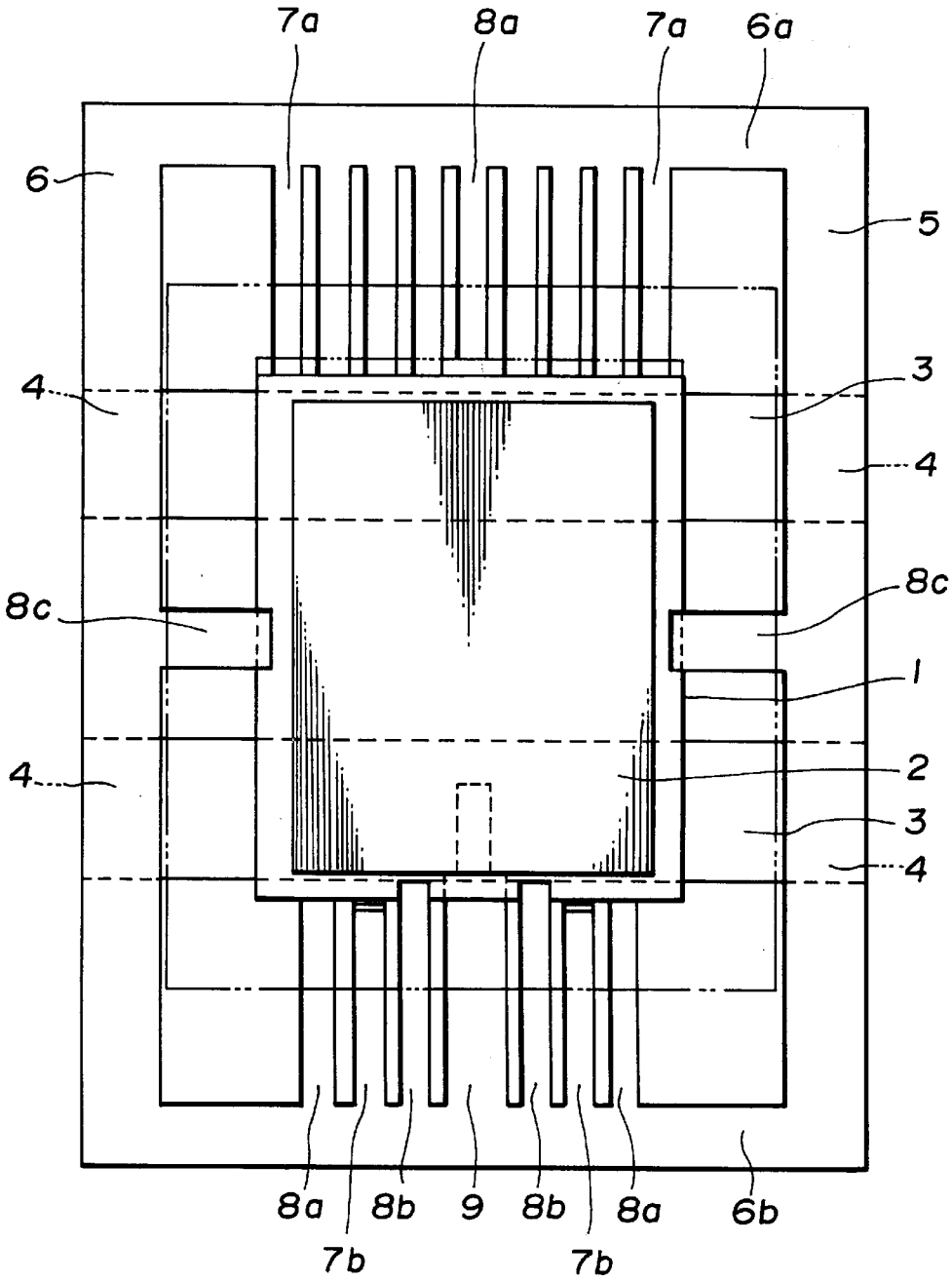
FIG. 2 is a plan view showing a lead frame and a cathode substrate in the fluorescent display device of FIG. 1.
Figure 3:
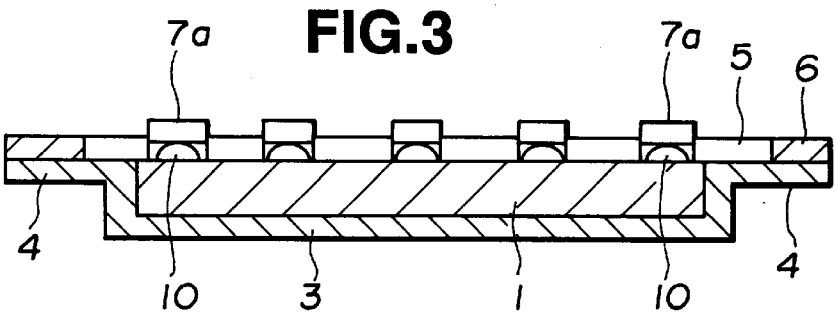
FIG. 3 is a sectional view taken along line A—A of FIG. 1.

Referring now to FIGS. 1 to 3, one step of a process for manufacturing a fluorescent display device according to the present invention is illustrated. As shown in FIGS. 1 to 3, a cathode substrate 1 which is made of Si into a rectangular shape is formed on an upper surface thereof with an FEC 2 acting as a planar cathode. The cathode substrate 1 is placed on two support members 3 made of a metal material. The support members 3 each are formed of a strip-like metal material into a rectangular shape so as to conform to a contour of the cathode substrate 1 and provided at each of both ends thereof with flanges 4. Then, a lead frame 5 is arranged on the cathode substrate 1 put on the support members 3. The lead frame 5 includes a frame section 6 formed into a rectangular shape larger than an outer configuration of an envelope to be assembled. The frame section 6 and the flanges 4 of each of the support members 3 are fixed to each other to attach the cathode substrate 1 to the lead frame 5. Arrangement of the cathode substrate 1 on the support members 3 facilitates connection to the ground.

The frame section 6 of the lead frame 5 is provided on an inner edge thereof with lead wires 7 (7*a*, 7*b*), holding leads 8 (8*a*, 8*b*, 8*c*) and a getter mounting pin 9. The lead wires 7 include a plurality of first lead wires 7*a* each formed on one 6*a* of short side portions 6*a* and 6*b* of the frame section 6 of the lead frame 5 and abutted, by predetermined elastic force, against a bump 10 of a terminal connected to each of electrode elements of the FEC 2 formed on the cathode substrate 1. The lead wires 7 also include a plurality of second lead wires 7*b* each formed on the other short side portion 6*b* of the frame section 6 in a manner to be upwardly bent at a distal end thereof, resulting in being connected to a terminal of the anode 12 formed on the anode substrate 11 as described hereinafter. The holding leads 8 include a plurality of first holding leads 8*a* of which one is formed on the one short side portion 6*a* of the frame section 6 and two are formed on the other short side portion 6*b*. The first holding leads 8*a* each are abutted against an end surface of each of both short side portions of the cathode substrate 1 corresponding thereto to position the cathode substrate 1 in a longitudinal direction thereof. The holding leads 8 also include a plurality of second holding leads 8*b* disposed on the other short side portion 6*b* of the frame section 6 so as to downwardly hold the other short side portion of the cathode substrate 1. Further, the holding leads 8 include a third holding lead 8*c* arranged on each of both long side portion of the frame section 6 of the lead frame 5 so as to downwardly hold each of long side portions of the cathode substrate 1. The one short side portion of the cathode substrate 1, as described above, is downwardly held by the first lead wires 7*a*. The getter mounting pin 9 is mounted with a getter 13 for adsorbing residual gas in an envelope described hereinafter.

Figure 4A:
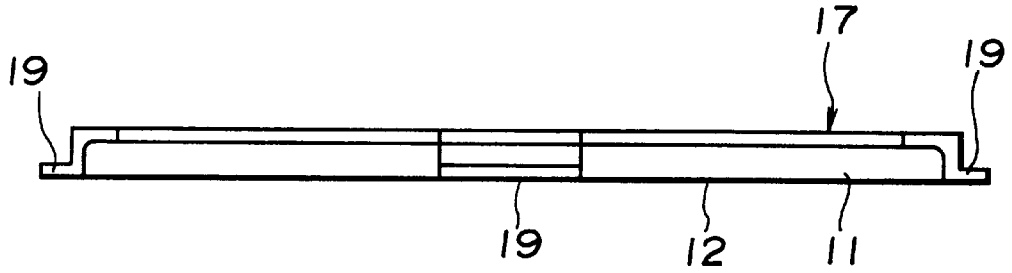
FIG. 4(*a*) is a plan view showing an anode substrate in the fluorescent display device of FIG. 1.
Figure 4B:
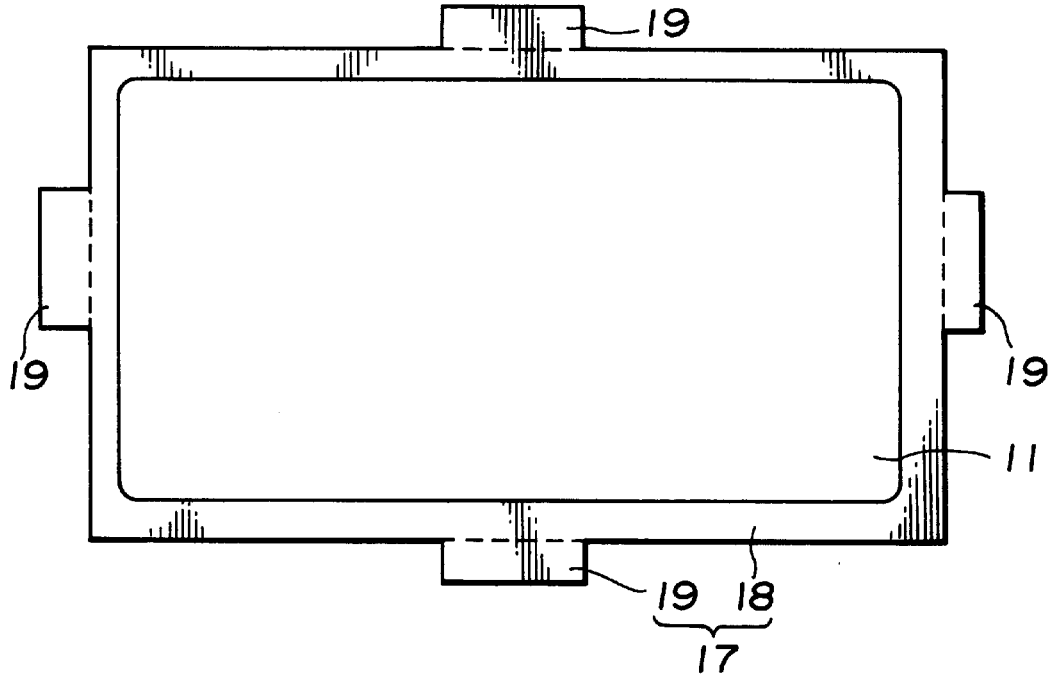
Figure 5:
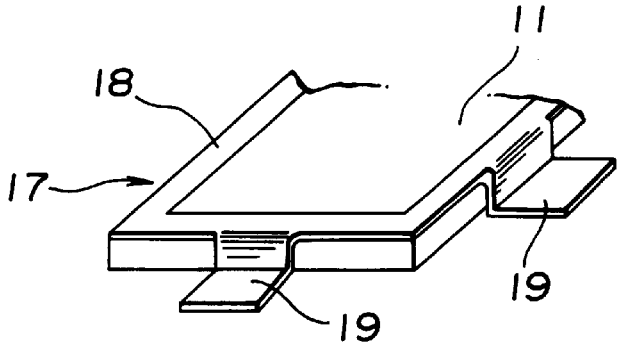
FIG. 5 is a fragmentary perspective view of the anode substrate shown in FIG. 4(*a*)
Figure 6:
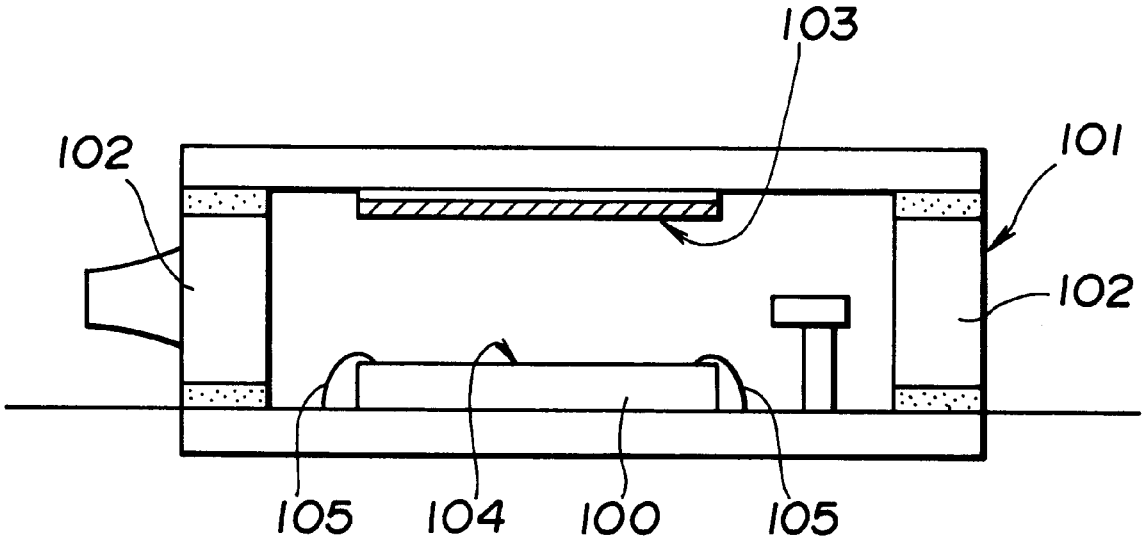
FIG.6 PRIOR ART
FIG. 6 is a sectional view showing a conventional fluorescent display device.

The anode substrate 11, as shown in FIGS. 1, 4 and 5, is formed on an inner surface thereof with an anode 12 comprising an anode conductor 14 and a phosphor layer 15 deposited thereon. The anode substrate 11 is mounted on an outer periphery thereof with a holding frame 17. The holding frame 17 includes a frame section 18 of a rectangular shape for covering a peripheral edge portion of an outer surface of the anode substrate 11 and four mounting flanges 19 formed so as to extend toward an inner surface of the anode substrate 11 from four sides of the frame section 18, to thereby outwardly project in the same plane as the inner surface of the anode substrate 11.

Then, as shown in FIG. 1, the cathode substrate 1 thus temporarily fixed to the lead frame 5 is then incorporated in an casing 20 formed of glass. More particularly, the lead frame 5 and envelope 20 are combined with each other so that the cathode substrate 1 supported on the support members 3 and the getter 13 are received in the casing 20 and the lead wires 7 of the lead frame 5 and the flanges 4 of the support members 3 are contacted with a peripheral edge of an opening of the casing 20. The peripheral edge of the opening of the casing 20 is provided thereon with a sealing material for forming a sealing layer 21 described hereinafter.

Subsequently, the anode substrate 11 is put on the lead frame 5 while keeping the anode 12 facing down, resulting in being aligned with the cathode substrate 1 as shown in FIG. 1. In this instance, both substrates 1 and 11 are arranged while being kept spaced from each other at a decreased interval therebetween, so that alignment therebetween may be carried out with high accuracy because alignment marks can be utilized for this purpose. Then, fixing is carried out between the mounting flanges 19 of the holding frame 17 of the anode substrate 11 and portions of the lead frame 5 against which the flanges 19 are abutted. The fixing may take place using any suitable means such as welding, caulking or the like. This permits the anode substrate 11 and cathode substrate 1 to be fixed to each other while being precisely aligned with each other with a predetermined interval being defined therebetween, to thereby prevent misregistration between a pattern of the anode 12 and that of the FEC 2 during a subsequent heat treatment. The fixing between the mounting flanges 19 of the holding frame 17 and the lead frame 5 causes the bumps 10 to be deformed or crushed to a degree sufficient not to exhibit a significant thickness.

Thereafter, a sealing step is executed to sealedly connect the anode substrate 11 and casing 20 to each other, resulting in an envelope 22 being formed. In this instance, the interval between the anode substrate 11 and the cathode substrate 1 is kept substantially constant by a thickness 5 of the lead frame interposed therebetween because the bumps 10 are deformed or crushed to a degree sufficient to fail to exhibit a thickness as described above. The lead wires 7 of the lead frame 5 are permitted to air-tightly extend through the sealing layer of the envelope 22, resulting in being contacted directly with the bumps 10 on the cathode substrate 1. Thus, the illustrated embodiment facilitates connection between the lead wires and the cathode substrate and ensures the electrical connection with increased reliability as compared with the prior art using wire bonding techniques.

Subsequently, the envelope 22 is evacuated through an evacuation hole 23 formed through the casing 20 and then the evacuation hole 23 is covered with a lid member 24. Then, an unnecessary part of each of the lead frame 5 and support members 3 is removed. The holding frame 17 mounted on the anode substrate 11 may be dismounted therefrom.

In the illustrated embodiment, the casing 20 is integrally formed of glass. Alternatively, it may be formed of a combination of glass plates into a box-like shape. Also, the bump for each of the terminals provided on the cathode substrate 1 may be made of any suitable material such as Au, Al, Cu, Ag, Ag/Pol or the like. Further, the lead wires 7 of the lead frame 5 contacted with the bumps 10 each are preferably formed so as to exhibit required elasticity. For this purpose, the lead wire may be bent or curled at a distal end thereof.

As can be seen from the foregoing, the present invention is so constructed that the cathode substrate formed separate from the envelope are supported by means of the support members and lead frame and the anode substrate constituting a part of the envelope is mounted on the holding frame, followed by fixing the lead frame to the holding frame after alignment between the cathode substrate and anode substrate. Such construction of the present invention permits positioning of the cathode substrate in the horizontal direction to be completed prior to formation of the envelope, resulting in alignment between the cathode substrate and the anode substrate being accomplished with high accuracy without being adversely affected by profile irregularity of the side section of the envelope during formation of the envelope.

Also, even when the cathode substrate is made of a material different in thermal expansion coefficient from that for the anode substrate, the envelope and/or cathode substrate are effectively prevented from being damaged because the cathode substrate is arranged in the envelope while being kept floating therein. Further, the cathode substrate may be provided on the rear surface thereof with a space for arranging the getter between the cathode substrate and the envelope, and the anode substrate anode substrate and cathode substrate are kept close to each other irrespective of the space.

Moreover, the planar cathode formed on the cathode substrate is connected at the terminal sections thereof to the lead wires while being kept pressed and the lead wires are connected to the cathode in the envelope kept evacuated, resulting in electrical connection therebetween being positively carried out.

While a preferred embodiment of the present invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising:

an envelope formed by integrally attaching an anode substrate and a casing to each other through a sealing layer;

an anode formed on said anode substrate in said envelope and having a phosphor layer deposited thereon;

support members fixed on said sealing layer forming a bridge across said envelope;

a cathode substrate placed horizontally on said support members, said cathode substrate being supported in said envelope by means of said support members in a manner to face said anode at a predetermined interval defined therebetween;

a field emission cathode formed on said cathode substrate; and a lead frame including lead wires arranged on top of said cathode substrate for downwardly holding said cathode substrate, said lead wires being arranged so as to extend through said sealing layer into said envelope and being connected to said cathode substrate.

2. A fluorescent display device as defined in claim 1, wherein said cathode substrate is formed of a material different in thermal expansion coefficient from a material for said casing.

3. A fluorescent display device as defined in claim 1, further comprising a getter arranged between said cathode substrate and said casing for adsorbing residual gas.

4. A fluorescent display device as defined in claim 3, wherein the getter is arranged on a getter mounting pin which is connected to said support members.

5. A fluorescent display device as defined in claim 1, wherein said support members include at least one strip material formed in a rectangular shape.

6. A fluorescent display device as defined in claim 5, wherein said support members include flanges on each end.

7. A fluorescent display device as defined in claim 6, wherein said lead frame and said flanges are fixed together to hold said cathode substrate in place.

8. A fluorescent display device as defined in claim 7, wherein said lead frame provides an elastic force to hold said cathode substrate against contacts on said lead wires.

9. A process for manufacturing a fluorescent display device, comprising the steps of:

mounting a cathode substrate formed thereon with a field emission cathode through support members on a lead frame including lead wires;

superposing a holding frame on which an anode substrate having an anode formed thereon is held through an outer periphery thereof on said lead frame in a manner to render said anode and cathode opposite to each other;

adjusting a positional relationship between said anode and said cathode;

connecting said lead frame and holding frame to each other;

sealedly attaching said anode substrate and a casing to each other while interposedly holding lead wires of said lead frame between said anode substrate and said casing, resulting in providing an envelope; and removing said holding frame from said envelope.

* * * * *